United States Patent [19]

Maissant

[11] Patent Number: 5,060,602

[45] Date of Patent: Oct. 29, 1991

[54] DEVICE FOR CONTROLLING OR MONITORING THE START OF INTRODUCTION UNDER PRESSURE, OF A FUEL-AIR MIXTURE FOLLOWING SCAVENGING OF AN ENGINE CYLINDER BY AIR

[75] Inventor: Jean-Pierre Maissant, Rueil Malmaison, France

[73] Assignee: Institut Francais du Petrole, Rueil Malmaison, France

[21] Appl. No.: 546,832

[22] Filed: Jul. 2, 1990

[30] Foreign Application Priority Data

Jun. 30, 1989 [FR] France ..... 89 08855

[51] Int. Cl.[5] ..... F01L 11/00

[52] U.S. Cl. ..... 123/47 A; 123/66; 123/73 PP

[58] Field of Search ..... 123/47 A, 66, 70 R, 123/70 V, 73 PP

[56] References Cited

U.S. PATENT DOCUMENTS

| | | | |
|---|---|---|---|
| 1,751,385 | 3/1930 | Beaudry | 123/70 V |
| 1,904,816 | 4/1933 | Beaudry | 123/70 V |
| 2,058,505 | 10/1936 | Reno | 123/66 |
| 2,522,649 | 9/1950 | Tenney | 123/70 R |
| 3,675,630 | 7/1972 | Stratton | 123/70 R |
| 3,921,608 | 11/1975 | Kottmann | 123/70 R |
| 4,211,082 | 7/1980 | Bristol | 123/70 R |
| 4,287,859 | 9/1981 | Noguchi et al. | 123/70 R |
| 4,628,888 | 12/1986 | Duret | 123/534 |
| 4,781,155 | 11/1988 | Brucker | 123/70 V |
| 4,944,255 | 7/1990 | Duret | 123/73 C |

FOREIGN PATENT DOCUMENTS

| | | | |
|---|---|---|---|
| 0056222 | 5/1977 | Japan | 123/70 R |

*Primary Examiner*—David A. Okonsky

*Attorney, Agent, or Firm*—Antonelli, Terry, Stout & Kraus

[57] ABSTRACT

A device (4, 5) for introducing, under pressure, a fuel-air mixture into a first cylinder of an internal combustion engine, with the engine comprising at least one other cylinder having a pump crankcase. A connecting passageway (9) is provided between the pump crankcase (12) and the upper part of first cylinder (1), with the passageway being supplied with fuel. A communication between the passageway and the combustion chamber of the first cylinder is blocked, and a non-zero angular offset exists between the cycles of the cylinders. The device (4, 5) controls the start of injection by interrupting, in an intermittent and predetermined fashion, the communication between the passageway (9) and the pump crankcase.

8 Claims, 8 Drawing Sheets

DEVICE FOR CONTROLLING OR MONITORING THE START OF INTRODUCTION UNDER PRESSURE, OF A FUEL-AIR MIXTURE FOLLOWING SCAVENGING OF AN ENGINE CYLINDER BY AIR

BACKGROUND OF THE INVENTION

The subject of the present invention is a device for controlling or monitoring the start of introduction, under pressure, of a fuel-air mixture following scavenging of an engine cylinder by air. Thus, the present invention relates to monitoring the start of pneumatic injection. The pressure source employed is supplied by the pressure prevailing in the crankcase which is offset at an angle and can be, in particular, retarded 120° (in the case of an engine with 3, 6, . . . , 3*n* cylinders) or retarded 90° (for an engine with 4, 8, . . . , 4*n* cylinders) relative to the cylinder in question into which the fuel-air mixture is introduced. This pressure source is not stored.

The present invention can be applied particularly to two-cycle internal combustion engines with spark ignition.

SUMMARY OF THE INVENTION

According to the present invention, the moment or instant of the beginning of introduction of the fuel-air mixture under pressure from this pressurized gas source into the cylinder in question is monitored. The arrival of gas coming from this pressure source at a fuel-metering element prepares a fuel-air mixture which can be introduced into the cylinder in question through an opening that is preferably open while the gas is coming from this pressure source. This opening can be in the cylinder head.

According to the present invention, this opening can be opened before the pressurized air arrives, since, according to the present invention, the start of injection is monitored by specific means. This opening, located near the cylinder in question, can comprise a rotating plug, a servo valve, or an automatic valve (of the check-valve type) whose opening is controlled by the pressure coming from the pressure source and from means monitoring the start of injection.

This opening can also be in the cylindrical walls of the cylinder in question itself. Its opening can then be controlled by the movement of the piston (in the case of a port) combined with a check-type valve (or a rotating plug).

For example, one embodiment of this type can consist in connecting the crankcase of the cylinder retarded 120° or 90° with respect to the cylinder in question by a passage coming from the side opposite the exhaust in the cylinder in question.

If the fuel-metering location (upstream from the inlet port terminating in the cylinder) is not at a pressure above ambient pressure for the entire time, apart from the period of introduction of the fuel-air mixture, this metering can be accomplished with the aid of low-pressure injectors, or with the aid of simpler devices as for example a carburetor of the type used on the intake of a two-cycle engine.

In the case of injection through a port machined in the cylinder in question, the system according to the invention allows injection to be retarded and hence the fraction short-circuited to the exhaust to be reduced.

In addition, using a piston of the deflector type can improve the operation of an engine equipped with an injection device in a rear port (opposite the exhaust port) according to the invention.

In the case of a valve controlled at the level of the cylinder in question, the system according to the invention allows opening of the servo valve to be advanced without any fuel being injected, hence increasing the opening time of the valve. Thus, the distribution (kinematic) is less severe during the critical mode, without increasing the short-circuiting of the fuel to the exhaust.

In the case of a servo valve at the level of the cylinder in question, the present invention permits injection to be retarded so that less fuel is wasted by short-circuiting to the exhaust. In addition, the dynamic effect produced by this retardation of the pressure wave can make it possible to use a stiffer spring, thus closing the valve more rapidly.

Finally, the device according to the invention may in certain cases, as regards injection offset by 90°, allow an even greater reduction of short-circuiting to the exhaust, which is naturally more pronounced than in the case of injection that has been offset 120°, by retarding the moment at which injection begins.

Thus, in a general fashion, the present invention relates to a device for introducing a fuel-air mixture under pressure into a first cylinder of an internal combustion engine, said engine having at least one other cylinder having a pump crankcase, a connecting passageway between this pump crankcase and the upper part of the first cylinder, means for supplying fuel to said passageway, and means for blocking communication between said passageway and the combustion chamber of the first cylinder, with a non-zero angular offset existing between the cycles of said cylinders.

According to the present invention, this device comprises means for controlling the start of injection, said means interrupting the communication between said passageway and said pump crankcase in an intermittent and predetermined manner.

These control means could comprise an opening made in the lower part of the other cylinder, said opening cooperating with the skirt of the piston of this other cylinder.

The skirt could have a port cooperating with this opening to regulate the start of injection. The "start of injection" regulated is the moment in time or in the cycle when injection begins.

The highest point of this opening may be located in the lower part of the other cylinder, in the vicinity of the lowest position occupied by the upper part of the piston in this other cylinder.

The skirt could comprise a port and its length could be adapted such that the lower part of this skirt blocks the opening as soon as the pressure in the pump crankcase is higher than the pressure in the upper part of the first cylinder in order to monitor the start of injection. Of course the opening will eventually be exposed by the port of the skirt when pneumatic injection begins.

The blocking means can comprise one of the following elements: an automatic valve, a controlled valve, a rotating plug, or a port machined in said first cylinder and cooperating with the piston of this first cylinder.

The passageway can comprise a check valve which prevents flow coming from the first cylinder into this passageway.

The offset between the first and the other cylinder can be in particular 90° or 120°.

The invention will become apparent from reading the following description of embodiments, illustrated by the attached drawings wherein:

DETAILED DESCRIPTION

The examples given below relate to a two-cycle engine.

Figure 1:
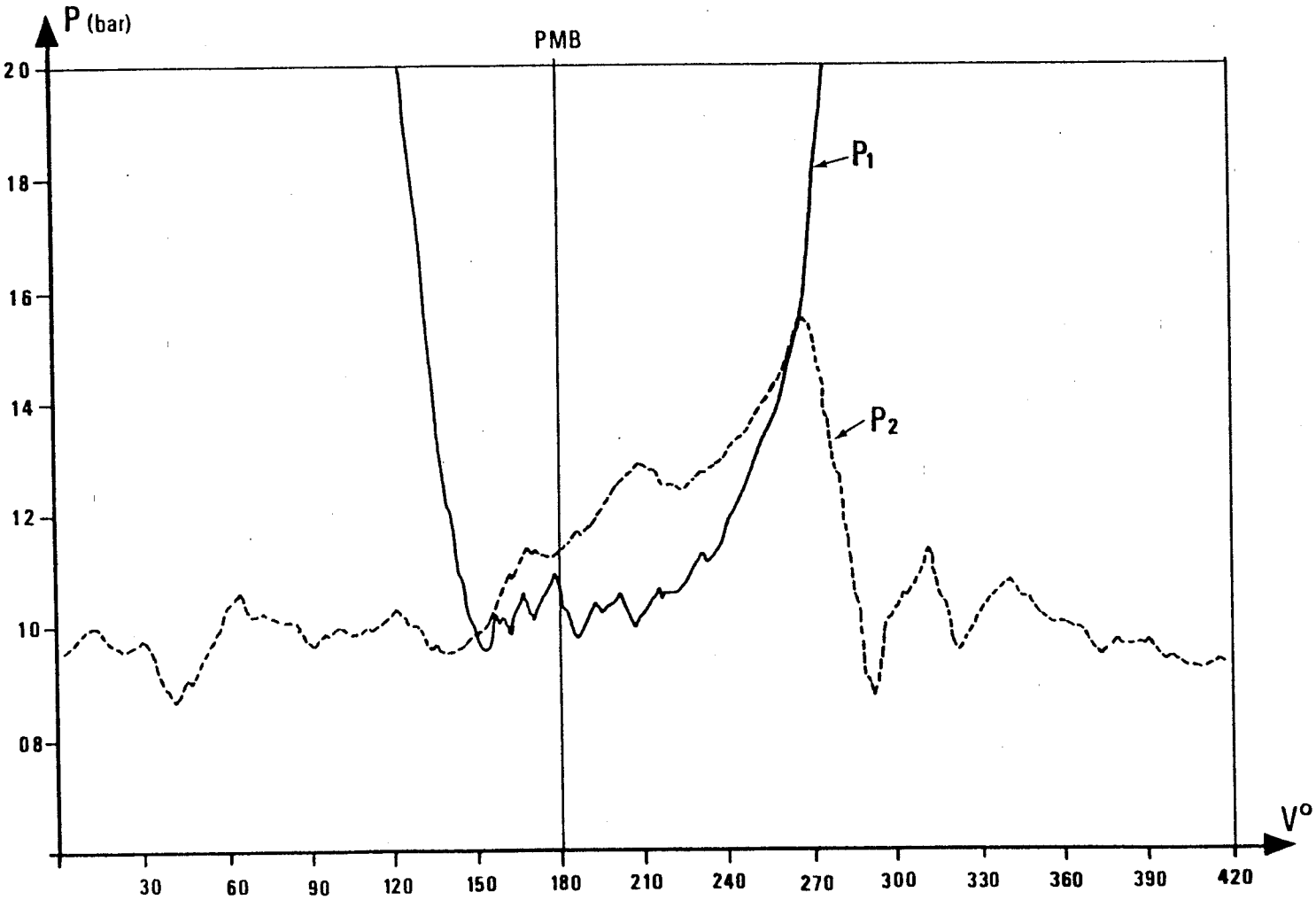
FIG. 1 shows the pressure curves of the cylinder and crankcase.

FIG. 1 shows in solid lines marked P1, the variation in the pressure of the cylinder into which the fuel-air mixture is injected during the scavenging phase of this cylinder. The cylinder is termed "the cylinder in question."

The pressure variation curve in the cylinder crankcase retarded 120° is indicated by the dotted line and is marked P2. This crankcase, retarded 120° relative to the cylinder in question, represents the pressurized gas source or the pressure source. FIG. 1 shows clearly that the pressure of this source is greater than the cylinder pressure during much of the scavenging extending from 150° to 265° retardation.

This pressure source can thus permit introduction of a fuel-air mixture throughout this part of the operating cycle of the cylinder in question when the pressure differential is sufficient.

The means for controlling the start of injection according to the invention make it possible to determine the most favorable instant for introducing this fuel-air mixture.

Figure 3A:
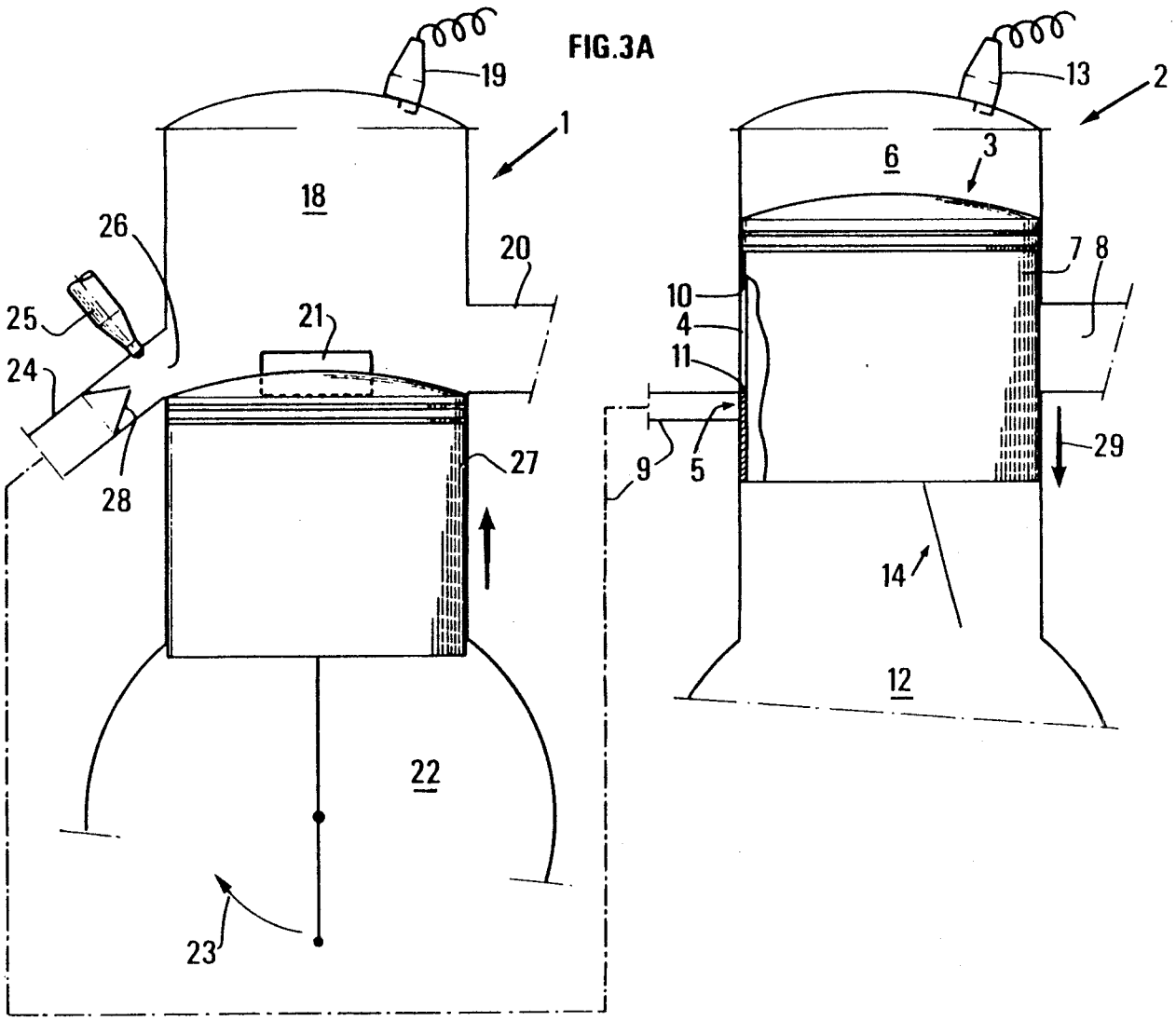
FIGS. 3A and 3F show the device according to the invention at different stages in the cycle.

Reference 1 represents the cylinder in which the fuel injection is performed, FIG. 3A.

Reference 2 represents the cylinder from which the start of injection is effected.

Figure 2A:
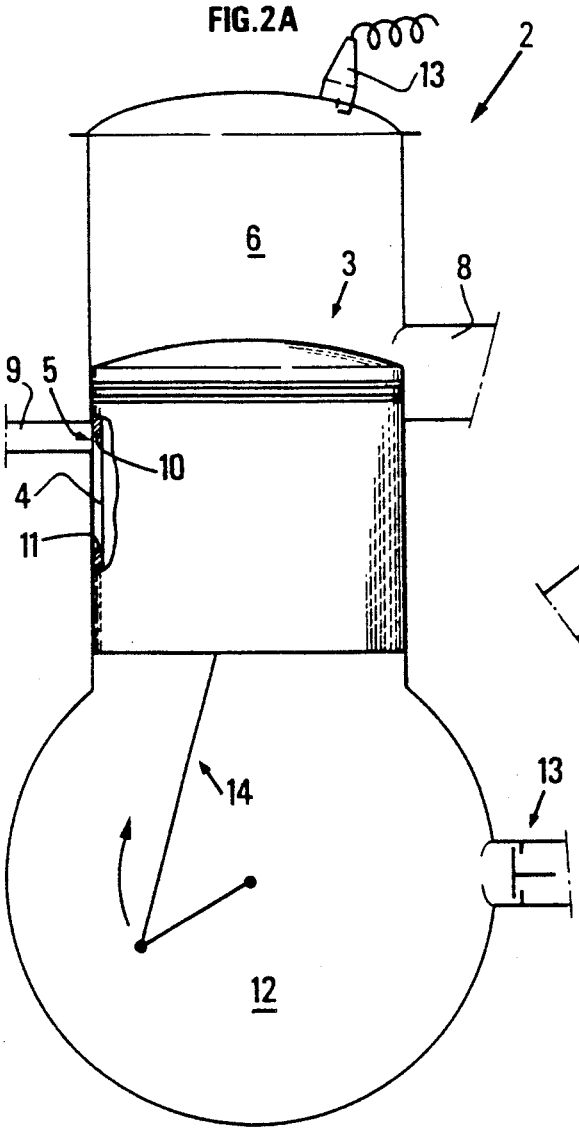
FIGS. 2 and 2A show in cross section a cylinder according to the invention.
Figure 2:
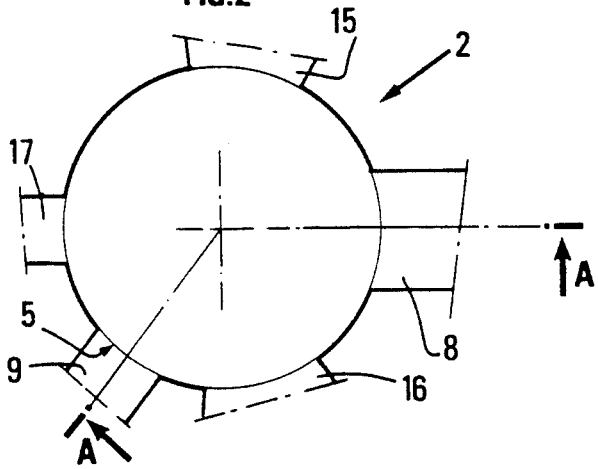

FIGS. 2 and 2A show a cylinder of this kind.

Reference 3 represents the piston, having a port 4 provided in its skirt 7 which cooperates with an opening 5 provided in the wall of the cylinder.

Opening 5 is preferably positioned so that it does not come in contact with combustion chamber 6 even when piston 3 is at bottom dead center (BDC).

Thus, opening 5 terminates in the part of the cylinder that cooperates with the skirt but which does not belong to the part which contains the burned gases.

Reference 8 represents the exhaust pipe.

Reference 9 designates the passageway connecting opening 5 with the cylinder in question.

The upper and lower edges 10 and 11 of port 4 as well as opening 5 are positioned to control the moments at which injection begins and ends.

Injection into the cylinder in question is accomplished with the aid of the compressed gases from pump crankcase 12 of cylinder 2.

Reference 13 represents the fresh-gas inlet valve in pump crankcase 12.

Reference 43 represents the spark plug and reference 14 the connecting rod-crankshaft assembly of cylinder 2.

FIG. 2A is a section along line AA in FIG. 2. In FIG. 2, references 15 and 16 represent the side transfer ports.

Reference 17 designates a rear injection port or a rear transfer port, depending on the case.

The elements common to FIGS. 2, 2A and 3A have the same reference numbers.

In FIG. 3A, as stated above, reference 1 designates the cylinder in which the introduction of the fuel is effected. FIG. 3A comprises a combustion chamber 18, a spark plug 19, an exhaust pipe 20, a transfer port 21, and a pump crankcase 22.

Arrow 23 shows the direction of rotation of the crankshaft. said p

Reference 24 shows the end of pipe 9 near the cylinder in question 1.

In this embodiment, injection is accomplished by a low-pressure injector 25. However, the latter can be replaced by a different fuel supply system such as a carburetor or an injection pump.

In the embodiment shown in FIG. 3A a port 26 cooperates with piston 27.

End 24 of pipe 9 terminates at this port 27, which communicates with combustion chamber 18 when piston 27 of the cylinder in question is at bottom dead center.

In this embodiment, a check valve 28 is used to prevent the return of gas to pump crankcase 12 of cylinder 2 serving as the pressure source. This valve 28 can be located anywhere in pipe 9 and the injector or fuel supply system can also be located either upstream or downstream of this valve.

Figure 3B:
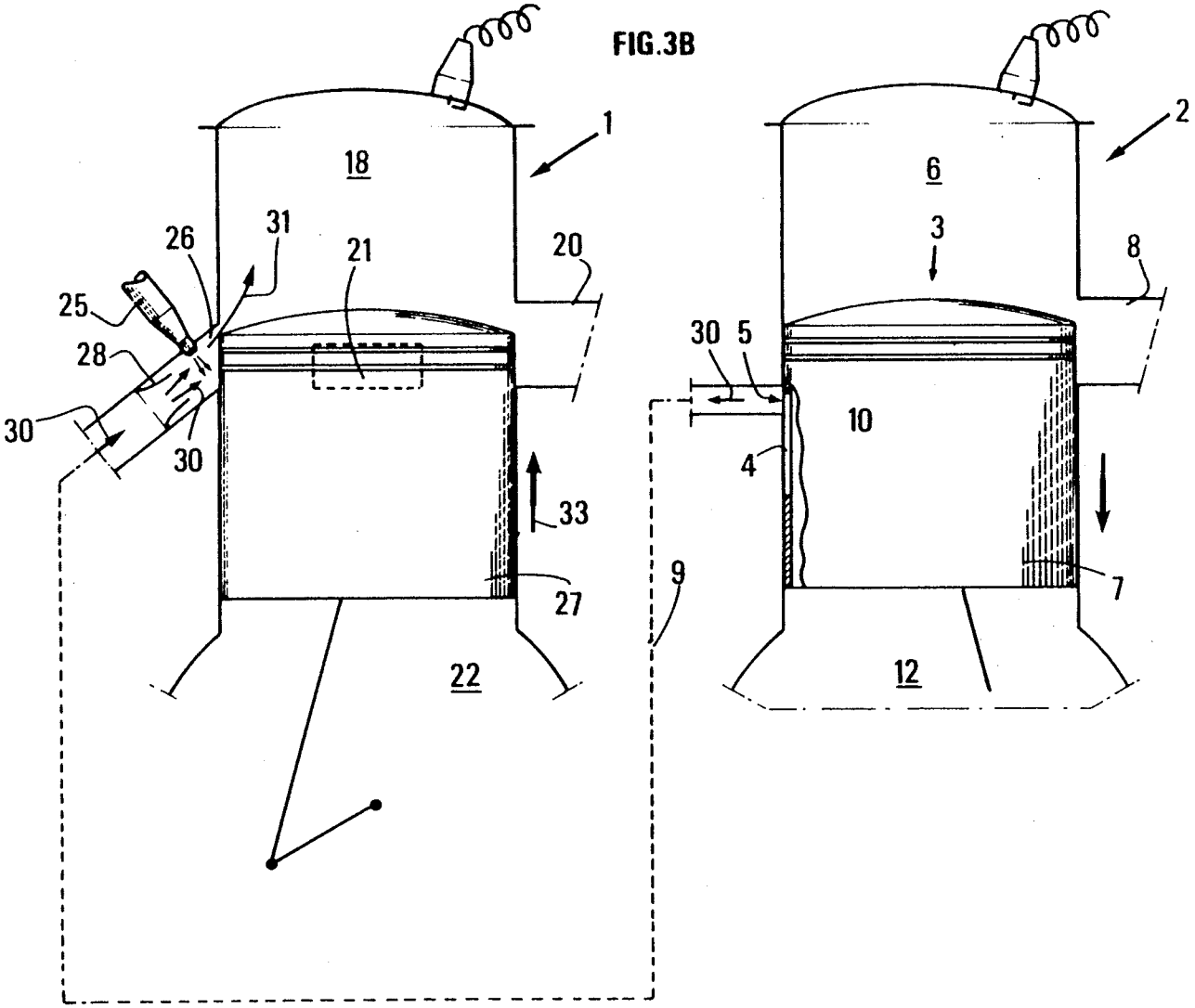
Figure 3D:
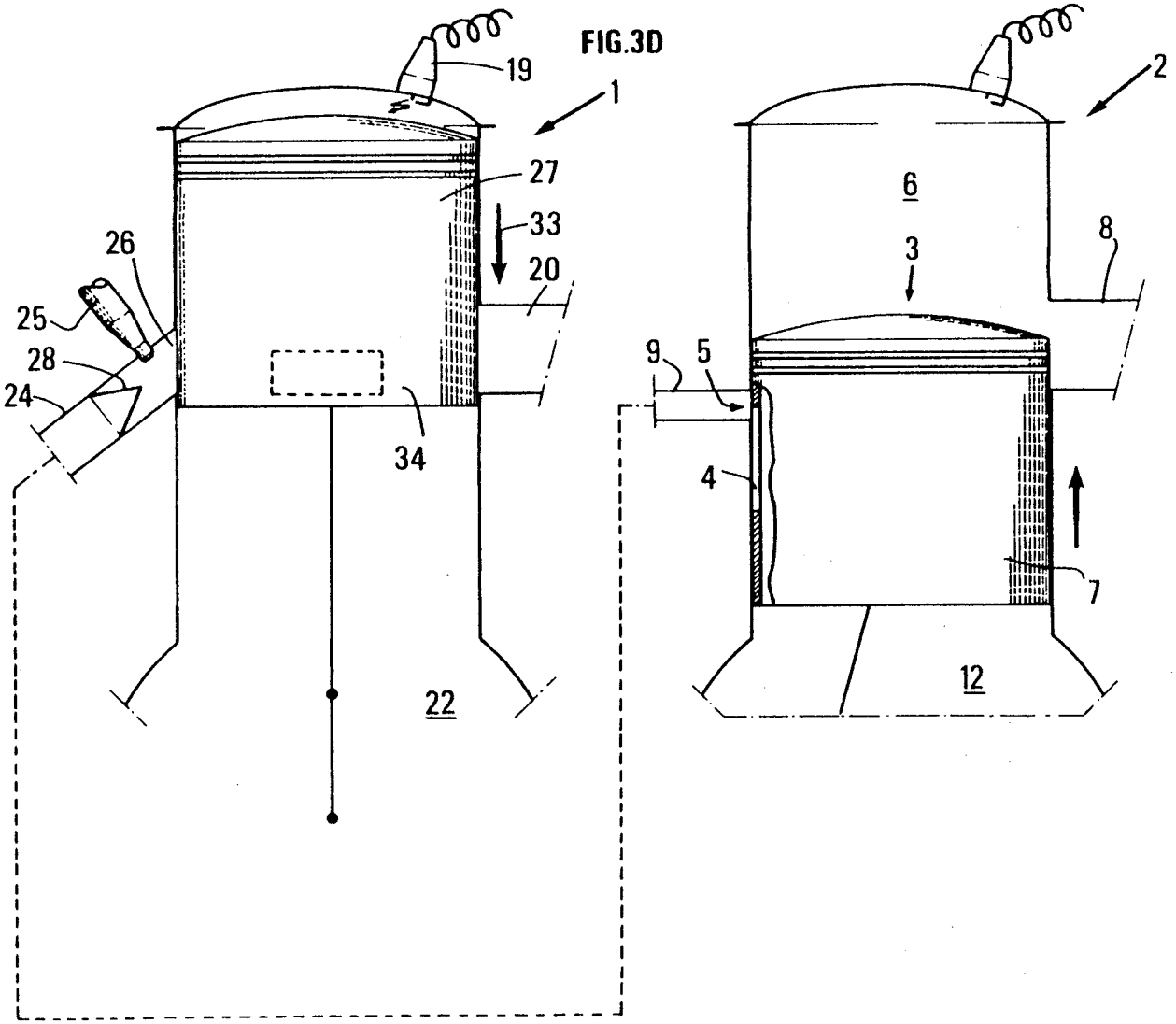
Figure 3E:
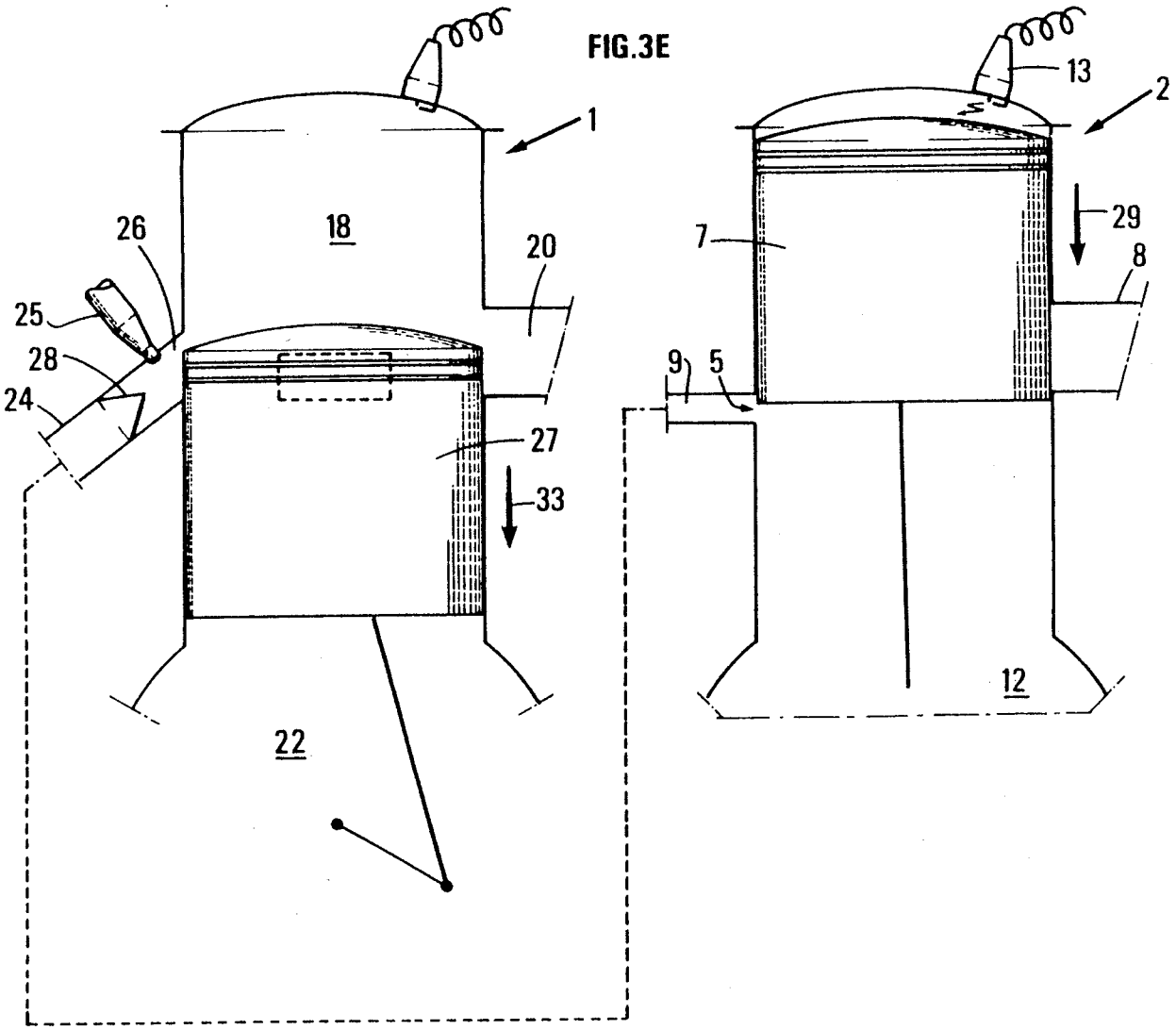
Figure 3F:
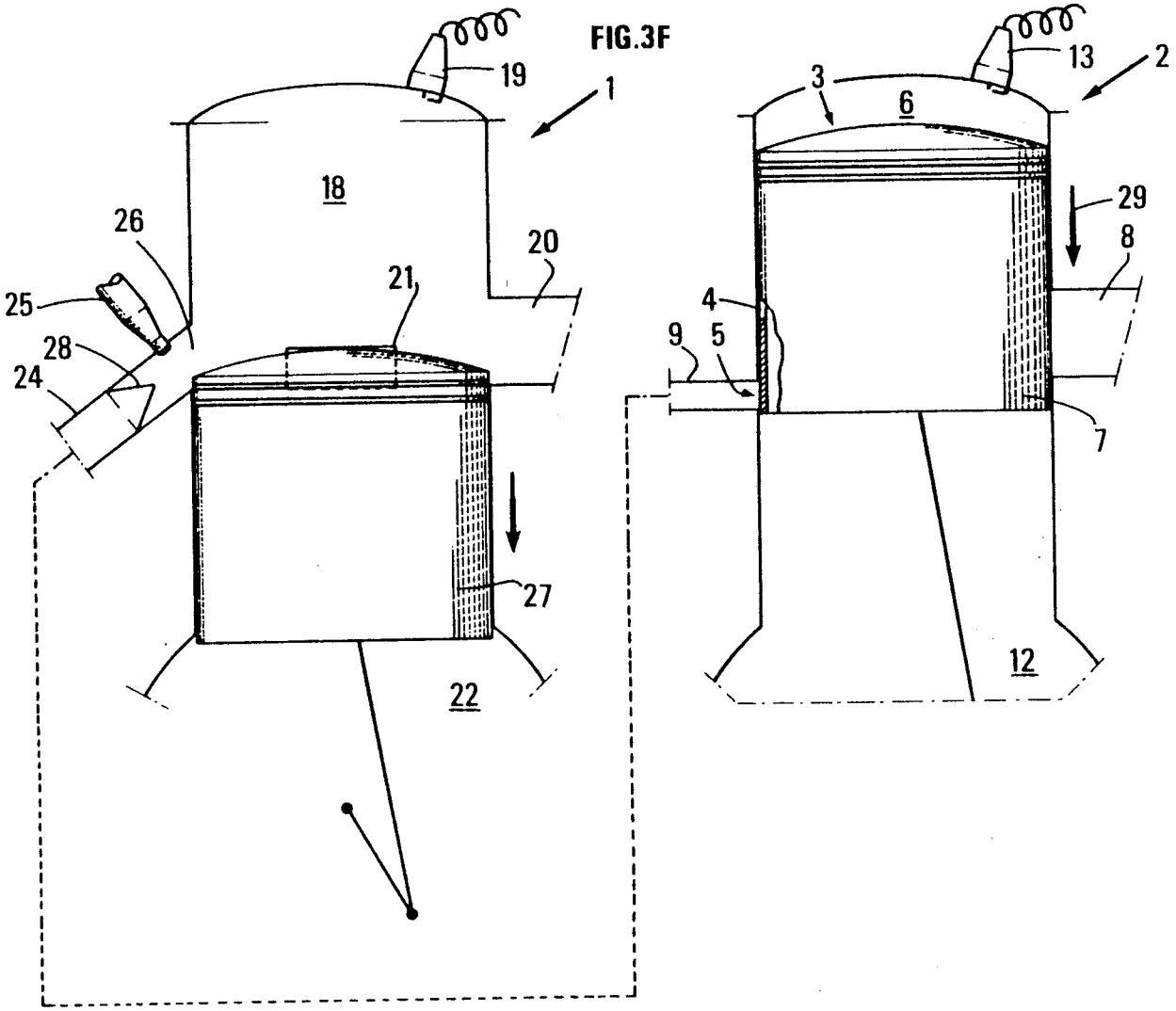

FIGS. 3A and 3F show the embodiment of FIG. 3A at different moments in the cycle.

The elements common to these figures have the same reference numbers and have been marked on the figures when necessary for good understanding of this description.

In FIG. 3A, cylinder opening 5 is about to be uncovered by port 4 provided in skirt 7 of piston 3.

Piston 3 is in the descending phase as shown by arrow 29. Edge 11 of port 4 is about to uncover opening 5.

Thus, the pressure in pump crankcase 12 serves as a pressure source for pneumatic injection into cylinder 1.

In this figure, the configuration of FIG. 7 of piston 3 is such that injection will not begin until piston 27 in cylinder 1 has reached bottom dead center. It therefore delays injection by at least 30° retardation. The position of edge 11 and of the height of port 4 of piston 3 determines the start and maximum duration of injection.

In FIG. 3B the side ports 21 of cylinder 1 are about to be covered and injection is on the point of being terminated.

Arrows 30 indicate the movement of the pressurized gas coming from crankcase 12 of cylinder 2.

The fuel introduced by injector 25 is atomized and transferred to combustion chamber 18 as shown by arrows 31.

The entire pneumatic injection device can be of the type described in French Patent 2,575,521.

The end of injection can be controlled by cylinder 27 which blocks port 26 or skirt 7 of piston 3 which in turn blocks opening 5 with edge 10 of port 4.

Valve 28 is open during injection.

Port 26 could be located slightly above side transfer ports 21.

In FIG. 3B, piston 27 is going up and piston 3 is coming down.

Figure 3C:
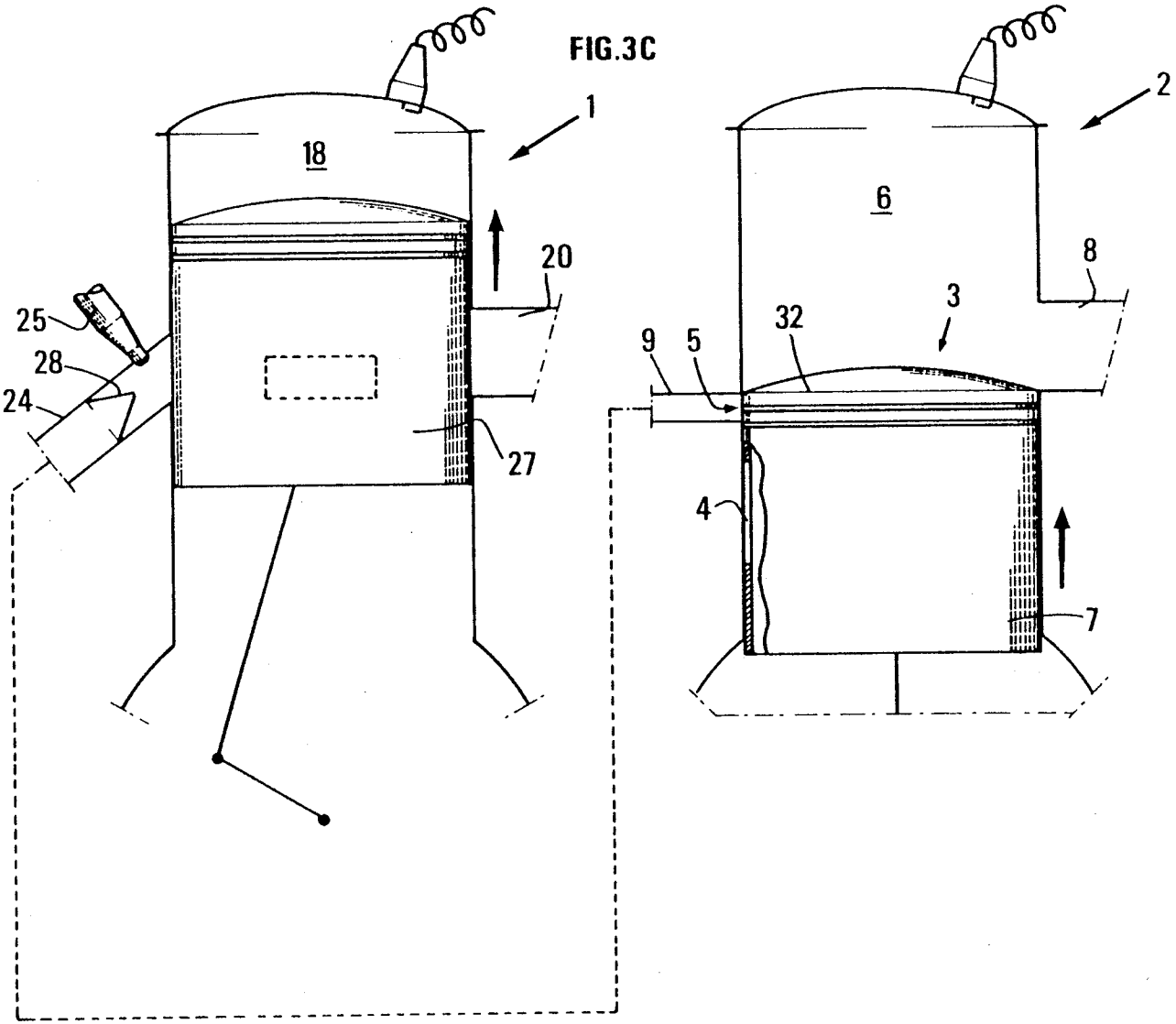

In FIG. 3C, pistons 27 and 3, whose cycles are staggered 120°, are going up. Pneumatic injection has ended and skirt 7 of cylinder 2 is covering opening 5. In this figure, piston 3 is at bottom dead center.

The upper end of opening 5 is flush with edge 32 of piston 3.

In FIG. 30, piston 27 is at top dead center and is about to start descending as indicated by arrow 33.

Piston 3 is in the ascending phase.

The height of skirt 34 of piston 27 and the position of port 26 can be designed to maintain a good seal between crankcase 12 and crankcase 22 when opening 5 has already been disconnected.

FIG. 3E shows the start of opening of injection port 26 of cylinder 1.

Valve 28 prevents gas from flowing from combustion chamber 18 toward pump crankcase 12.

Finally FIG. 3F corresponds to a position of piston 1 which is retarded 150° after top dead center.

The gas pressure in crankcase 12 begins to be higher than the pressure in combustion chamber 18.

It is appropriate, at 150° retardation after top dead center in cylinder 1, for opening 5 to be blocked by piston 3, momentarily preventing crankcase 12 from emptying into cylinder 1.

Figure 4:
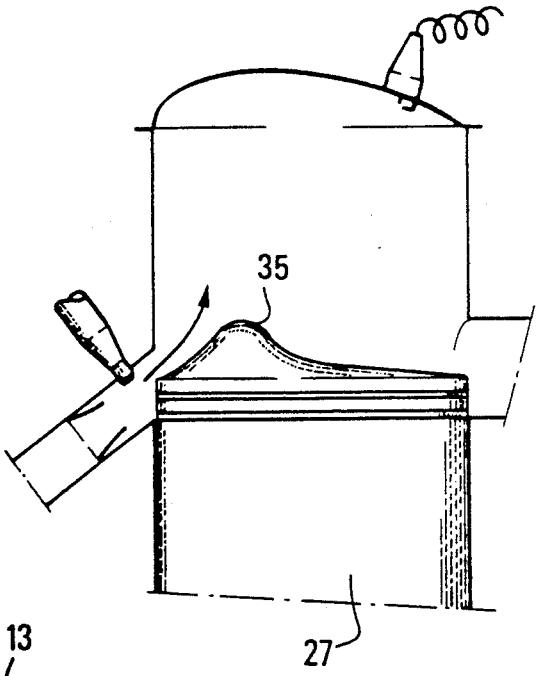
FIG. 4 shows a deflecting device.

In FIG. 4, piston 27 of cylinder 1 comprises a deflector 35 to improve the functioning of the device.

In the embodiment according to the invention shown in FIGS. 3A to 3F, a valve 28 is shown at end 24 of pipe 9. It will not constitute a departure from the scope of the present invention to replace this device by a device such as a valve controlled by a rotary plug like that described in EP 296,969.

Finally, cylinder 1 can comprise the same system as cylinder 2 and can serve for pneumatic injection into a third cylinder advanced 120° or 90° relative to cylinder 1.

I claim:

1. Device for controlling the start of introduction, under pressure, of a fuel-air mixture into a first cylinder of an internal combustion engine, said engine comprising at least one other cylinder having a pump crankcase, a passageway to provide a connection between said pump crankcase and the upper part of the first cylinder, means for injecting fuel into said passageway and means for blocking communication between said passageway and the combustion chamber of the first cylinder, with a non-zero angular offset existing between the cycles of said pistons, characterized by comprising control means for controlling a start of injection, said control means interrupting in an intermittent and predetermined fashion, communication between said passageway and said pump crankcase, wherein said control means comprises an opening provided in a lower part of said other cylinder, said opening being blocked by a skirt of the piston of said other cylinder.

2. Device according to claim 1, characterized by said skirt having a port cooperating with said opening to regulate the start of injection.

3. Device according to one of claims 1 or 2, characterized by a highest point of said opening being located in the lower part of said other cylinder in a vicinity of a lowest point occupied by an upper part of the piston of said other cylinder.

4. Device according to claim 1, characterized by said skirt having a port, said skirt being such that the lower part of said skirt blocks said opening as soon as the pressure in said pump crankcase is higher than the pressure in an upper part of said first cylinder, said opening being uncovered later to permit pneumatic injection to begin.

5. Device according to claim 1, characterized by said blocking means comprising one of an automatic valve, a servo valve, a rotating plug, or a port provided in said first cylinder cooperating with the piston of said first cylinder.

6. Device according to claim 1, characterized by said passageway including a check valve preventing flow originating in said first cylinder from entering said passageway.

7. Device according to claim 1, characterized by the offset between the cylinders being either 90° or 120°.

8. Device according to claim 1, wherein each of the cylinders are power cylinders which operate in a two-cycle manner.

* * * * *